US005588595A

United States Patent [19]

Sweet et al.

[11] Patent Number: 5,588,595

[45] Date of Patent: Dec. 31, 1996

[54] NUTATING SPRINKLER

[75] Inventors: Frederick J. Sweet, College Place; Larry P. Meyer, Walla Walla, both of Wash.

[73] Assignee: Nelson Irrigation Corporation, Walla Walla, Wash.

[21] Appl. No.: 446,099

[22] Filed: May 19, 1995

Related U.S. Application Data

[63] Continuation-in-part of Ser. No. 212,938, Mar. 15, 1994, Pat. No. 5,439,174.

[51] Int. Cl.[6] ..... B05B 3/02

[52] U.S. Cl. ..... 239/222.17; 239/222.11; 239/223

[58] Field of Search ..... 239/214, 216, 239/222, 222.11, 222.17, 222.21, 223, 232, 240, 251, 255, 263, 380, 382, 383, DIG. 1

[56] References Cited

U.S. PATENT DOCUMENTS

| | | | |
|---|---|---|---|
| 2,639,191 | 5/1953 | Hruby, Jr. | 239/18 |
| 2,848,276 | 8/1958 | Clearman | 239/68 |
| 3,009,648 | 11/1961 | Hait | 239/201 |
| 3,034,728 | 5/1962 | Hruby, Jr. | 239/206 |
| 3,312,400 | 4/1967 | Clearman | 239/206 |
| 3,532,273 | 10/1970 | Siddall et al. | 239/222.17 |
| 4,073,438 | 2/1978 | Meyer | 239/227 |
| 4,290,557 | 9/1981 | Rosenberg | 239/222.21 |
| 4,398,666 | 8/1983 | Hunter | 239/222.13 |
| 4,486,449 | 12/1984 | Hunter | 239/232 |
| 4,487,368 | 12/1984 | Clearman | 239/229 |
| 4,660,766 | 4/1987 | Nelson et al. | 239/222.17 |
| 4,796,811 | 1/1989 | Davisson | 239/222.17 |
| 5,086,842 | 2/1992 | Cholet | 166/312 |
| 5,224,653 | 7/1993 | Nelson et al. | 239/222.17 |
| 5,415,348 | 5/1995 | Nelson | 239/71 |
| 5,439,174 | 8/1995 | Sweet | 239/222.17 |

FOREIGN PATENT DOCUMENTS 54127 9/1975 Australia .

OTHER PUBLICATIONS

Senninger brochuer, "Nothing Wets Like the Wobbler®". (Not Given).

*Primary Examiner*—Kevin P. Shaver
*Assistant Examiner*—Lisa Douglas
*Attorney, Agent, or Firm*—Nixon & Vanderhye P.C.

[57] ABSTRACT

A sprinkler comprising a body portion having a nozzle at one end and a cap assembly supported thereon at an opposite end, the cap assembly supporting a spray plate located downstream of the nozzle, the spray plate having a plurality of stream distributing grooves formed on one side thereof configured to cause the spray plate to rotate when struck by a stream emitted from the nozzle; and wherein the spray plate includes a mounting shaft extending from the spray plate and having a part spherical head received within a bearing cage in the cap assembly, the bearing cage including a bearing separator holding a plurality of ball bearings in a substantially horizontal array arranged about a longitudinal center axis of the sprinkler, the part spherical head located centrally above and in engagement with the plurality of ball bearings, thereby permitting the spray plate to wobble as it rotates.

15 Claims, 4 Drawing Sheets

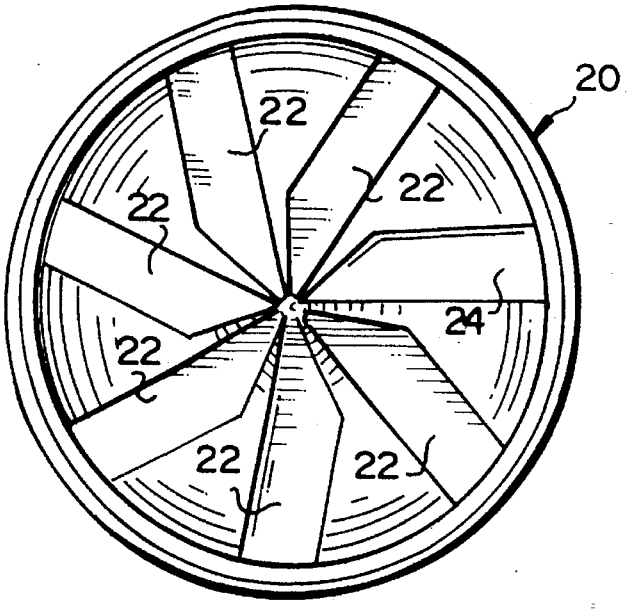
FIG. 4
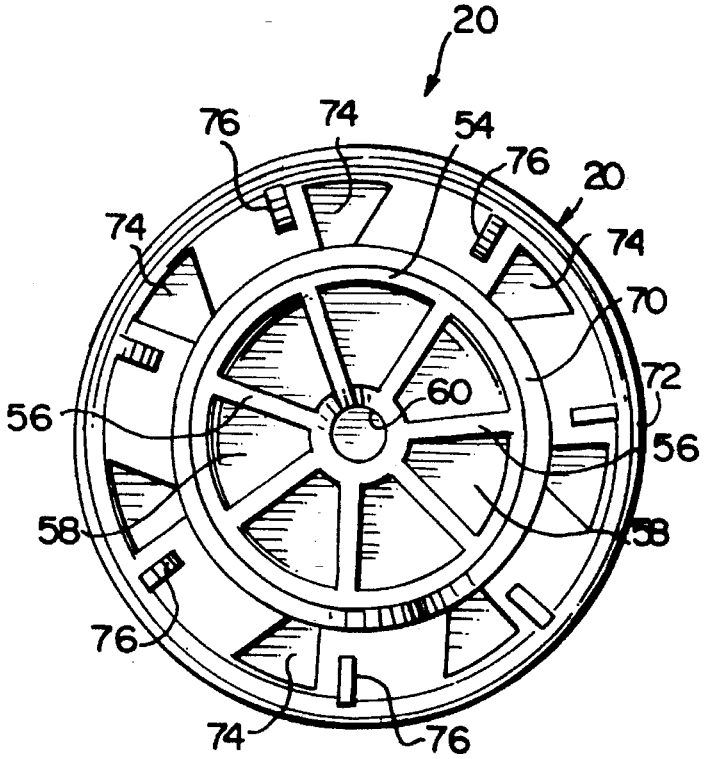
FIG. 5
FIG. 6
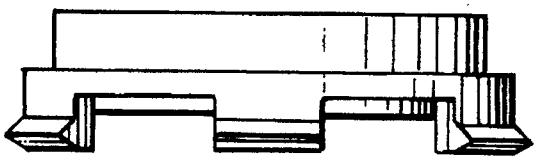

NUTATING SPRINKLER

RELATED APPLICATIONS

This application is a continuation-in-part of commonly owned application Ser. No. 08/212,938 filed Mar. 15, 1994, now U.S. Pat. No. 5,439,174.

BACKGROUND AND SUMMARY OF THE INVENTION

This invention relates to modular sprinkler devices and, more specifically, the invention relates to an improved sprinkler which incorporates a spray plate mounted for wobbling/rotating motion referred to herein as "nutation".

Moving irrigation systems, such as conventional pivot move (or center pivot) and lateral (or linear) move systems, are known to incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assemblies by means of drop tubes. The sprinkler heads typically incorporate rotatable stream distributors (also referred to as rotor plates or spray plates), fixed spray plates or bubbler devices.

When irrigating large areas of land with center pivot or linear systems, the sprinklers need to be spaced apart as far as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at a relatively high trajectory angle (approximately 20° up from horizontal); however, these streams tend to produce a "donut" shaped sprinkling pattern that does not overlap evenly.

It is the principal objective of this invention to solve the above problem by employing a multi-stream rotor or spray plate that wobbles as it rotates in conjunction with a new and superior bearing arrangement. More specifically, the rotor or spray plate is free to move with reduced friction in a set motion through the use of a unique ball bearing arrangement where the spray plate mounting shaft is secured within the cap assembly. This arrangement is combined with continuous rolling contact between the rotating spray plate and the stationary cap assembly, about an annular surface of the spray plate, during nutation of the spray plate. This invention results in controlled nutating movement of the spray plate which causes the water streams to rotate consistently and fill in the sprinkling pattern uniformly.

In an exemplary embodiment of the invention, the sprinkler itself includes generally a sprinkler body, a removable cap assembly, a nozzle and a connector/adaptor. The cap assembly is modified to incorporate a rotor or spray plate which redirects a stream issuing from the fixed nozzle in a substantially radial direction by reason of a multi-groove configuration on a plate. These grooves are provided with combined radial and circumferential shape components (as opposed to only a radial component) so that the spray plate is caused to rotate when struck by the stream emitted from the nozzle. In addition, the underside of the rotor or spray plate includes a central annular hub projecting from the underside of the plate. A shaft supports the spray plate at one end thereof and projects outwardly from the hub. The other end of the shaft is formed with a part spherical head which is received within a complementary spherical ball retainer cage in the cap assembly. The part spherical shaft head engages three ball bearings in the cage of the sprinkler. This unique shaft mounting arrangement facilitates universal wobbling movement of the shaft about a longitudinal axis extending through the nozzle and the center of the cap assembly, as the shaft head and bearings move relatively freely within the bearing cage. A ball separator is also free to slidably rotate within the bearing housing in the sprinkler cap assembly.

An annular rim on the underside of the spray plate is formed with a bevelled surface (also referred to as a rotor ring) which rolls about a complementary bevelled surface (also referred to as a stator ring) on the interior of the otherwise stationary cap assembly as the spray plate nutates about the longitudinal axis of the sprinkler.

The arrangement is such that the water stream exiting the nozzle impacts the tilted rotor/spray plate, travels through the grooves and exits the tilted rotor/spray plate on the outside diameter. As the water stream travels through the grooves, it causes the rotor/spray plate to nutate (oscillate with an off center motion) about a common center of motion, i.e., the longitudinal axis of the sprinkler. As the tilted rotor plate nutates, the nose of the plate oscillates in a clockwise motion, while the bevelled surface (or rotor ring) inside the skirt of the rotor plate rolls around the stator ring surface on the cap, in continuous contact. The circumference of the contact surface on the rotor plate is less than the circumference of the stator ring, however, and thus the rotor plate indexes counter-clockwise a distance equal to the difference of the circumferences. In other words, the point of contact between the rotor ring and the stator ring "walks" or "indexes" about the stator ring in one direction as the plate nutates about the longitudinal axis in an opposite direction.

Because of the difference in circumference dimensions, there will be some slippage of the rotor plate on the stator ring during operation. This slippage will incorporate some randomness into the sprinkling pattern and enhance the overall uniformity of the wetted area.

Thus, in accordance with the broader aspects of the invention, there is provided a sprinkler comprising a body portion having a nozzle at one end and a cap assembly supported thereon at an opposite end, the cap assembly supporting a spray plate located downstream of the nozzle, the spray plate having a plurality of stream distributing grooves formed on one side thereof configured to cause the spray plate to rotate when struck by a stream emitted from the nozzle; and wherein the spray plate includes a mounting shaft extending from the spray plate and having a part spherical head received within a bearing cage in the cap assembly, the bearing cage including a bearing separator holding a plurality of ball bearings in a substantially horizontal array arranged about a longitudinal center axis of the sprinkler, the part spherical a head located centrally above and in engagement with the plurality of ball bearings, thereby permitting said spray plate to wobble as it rotates.

In another aspect, the present invention relates to a sprinkler comprising a body portion supporting a nozzle and a rotatable spray plate in axially spaced relationship to the nozzle, the spray plate having a mounting shaft formed with a part spherical head on an end thereof remote from the spray plate, the part spherical head received in a bearing cage containing a plurality of ball bearings.

It will be appreciated that the controlled rotating/wobbling motion results in water being thrown from the rotor plate at different trajectory angles in a continuously changing manner, the motion controlled by the use of ball bearings and complementary engaging surfaces cause the water streams to rotate consistently while filling in the sprinkling pattern evenly, thus avoiding the "donut" pattern described hereinabove.

Other objectives and advantages of the present invention will become apparent from the detailed description which follows.

BRIEF DESCRIPTION OF THE DRAWINGS

FIG. 4 is a top plan of a spray plate incorporated in the sprinkler shown in FIG. 1;

FIG. 5 is a bottom plan view of the spray plate shown in FIG. 4;

FIG. 6 is a side elevation of a stator wear ring incorporated in the sprinkler shown in FIG. 1;

DETAILED DESCRIPTION OF THE DRAWINGS

Figure 1:
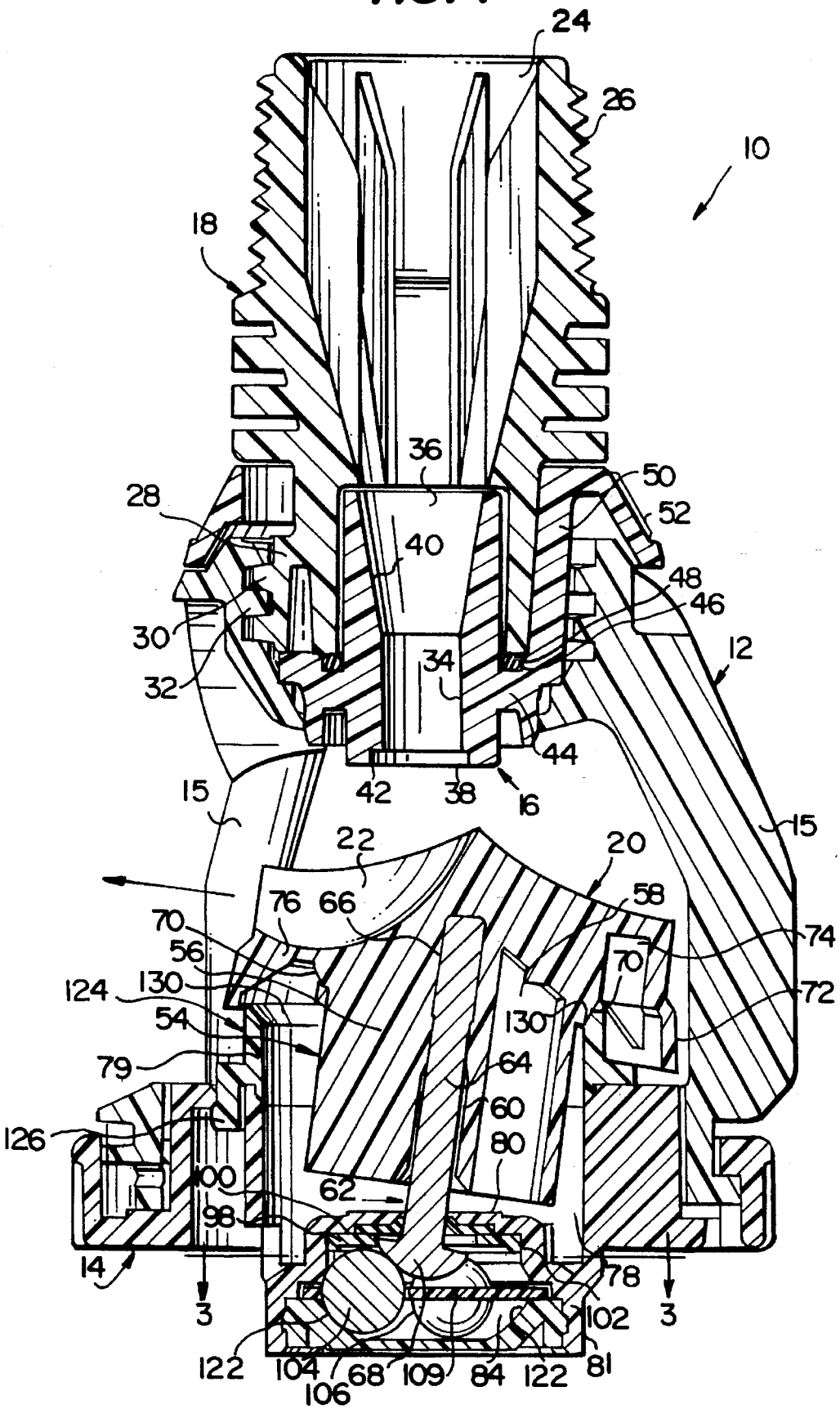
FIG. 1 is a cross section of a sprinkler in accordance with the invention.

With reference to FIG. 1, the nutating sprinkler 10 in accordance with this invention includes generally, a sprinkler body 12, a removable cap assembly 14, a nozzle 16, and a connector/adaptor 18. The cap assembly 14 is an easily removable, positive latching type cap of the type disclosed in commonly owned, copending application Ser. No. 08/113,046 now U.S. Pat. No. 5,409,168, incorporated herein by reference. The cap assembly 14, which is supported on a plurality of struts 15 extending from the body 14 (these equally spaced struts are employed, but only two are shown in FIG. 1) is modified in this application however, to accommodate a rotor or spray plate 20 which redirects in a substantially radial direction, a stream issuing from the nozzle 16 by reason of the multi-groove configuration on the plate. In other words, the various grooves 22 (see also FIG. 4) formed in the spray plate, are configured to cause the spray plate to rotate about a wobbling axis in a controlled manner as will be described in more detail below. The configuration of the grooves to include both radial and circumferential components to cause rotation of a spray plate is by itself, well known.

The connector/adaptor 18 includes a male inlet end 24 provided with an external screw thread 26 adapted for connection to a pivot drop tube, supply pipe, hose or the like. The connector/adaptor 18 also includes a male outlet end 28 which is provided with an external discontinuous screw thread 30 adapted for threaded engagement with internal thread 32 in the inlet portion of the body 12.

The nozzle 16 includes a central, tubular portion 34 defining a flow passage having an inlet 36 at one end and a discharge orifice 38 at an opposite, outlet end. The nozzle flow passage tapers inwardly at 40 from the inlet end of the nozzle to a midpoint of the flow passage, where the diameter remains constant until it reaches the discharge orifice 38 which is defined by a slightly enlarged radial shoulder 42. The outlet end includes an annular flange 44 formed with an annular groove 46 for receiving an O-ring 48. At the radially outermost end of the flange 44 of the nozzle 16, four circumferentially spaced webs or struts 50 are provided which are spaced radially outwardly of the tubular portion 34, and which extend substantially axially toward the inlet 36 of the nozzle. These webs or struts 50 support an annular identification band or ring 52 which lies radially outwardly of the webs or struts 50 and which also lies radially outwardly of the adaptor 18 so as to be easily visible. It will be understood that ring 52 may be color coded and/or contain indicia enabling the user to quickly identify the nozzle by size. The specific construction of the connector/adaptor 18 and nozzle 16 as illustrated here may be as disclosed in commonly owned U.S. Pat. No. 5,415,348 also incorporated herein by reference. The nozzle assembly 16 as shown is of one-piece plastic construction. it will be appreciated however (and as shown in the '348 patent), that the nozzle itself may be brass or other suitable material, fitted within the plastic web and ring structure.

Figure 2:
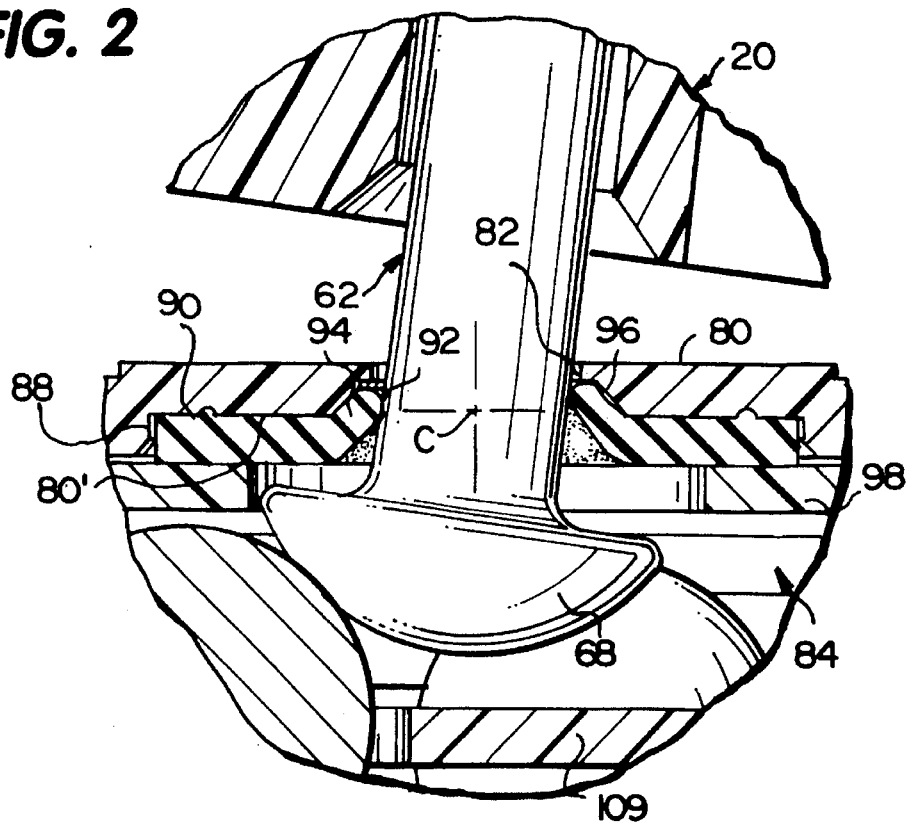
FIG. 2 is an enlarged detail taken from FIG. 1.
Figure 3:
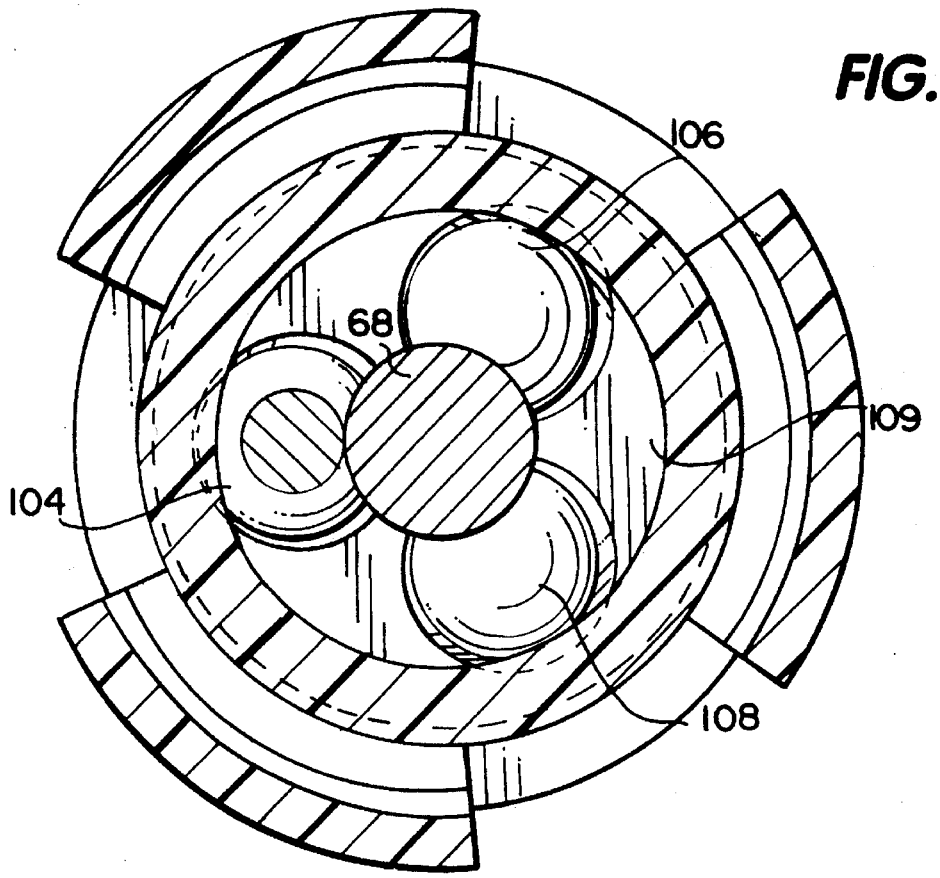
FIG. 3 is a section taken along the line 3—3 of FIG. 1.

Returning to the rotor or spray plate 20, and as best seen in FIGS. 1 and 4, the underside of the plate, i.e., that side opposite the side on which the water stream receiving grooves 22 are located, includes a cylindrically shaped annular hub 54 projecting from the undersurface of the plate. As best seen in FIG. 5, the hub 54 is essentially hollow, but with a spider configuration of radial webs 56 separated by wedge-like spaces 58. The webs 56 extend from a center bore 60 which receives a headed steel shaft 62. The shaft 62 includes a smooth shank portion 64, a splined portion 66 at one end and a part spherical head 68 at the opposite end. The splined portion 66 and most of the smooth shank are received within the bore such that the head 68 projects from the rear of the hub 54 as shown in FIGS. 1 and 2.

At the base of the cylindrical hub 54, there is a bevelled surface or rotor ring 70 which extends about the hub 54 radially between the hub and the undersurface of the plate. A radially outer depending skirt 72 surrounds and protects the rotor ring 70 from dirt and debris and, in this regard, note that the skirt 72 extends axially in a direction toward the head of the shaft, and beyond the ring 70.

Annularly spaced recesses 74 formed in the undersurface of plate 20 (see FIG. 5) and which extend into the areas between the water emitting grooves, save weight, while radial gussets 76 provide strength to the skirt.

Figure 7:
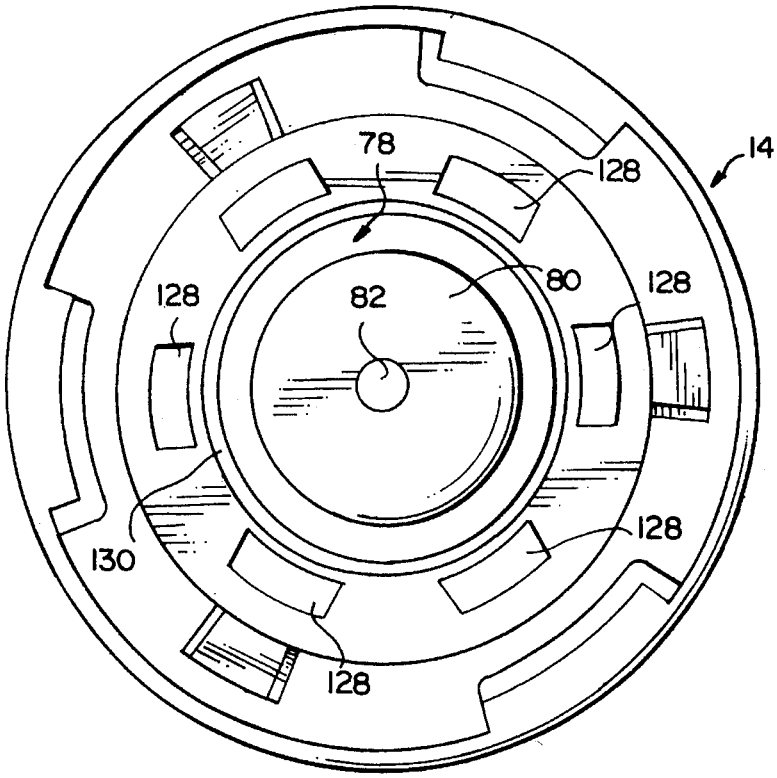
FIG. 7 is a top plan view of a cap incorporated in the sprinkler shown in FIG. 1.
Figure 8:
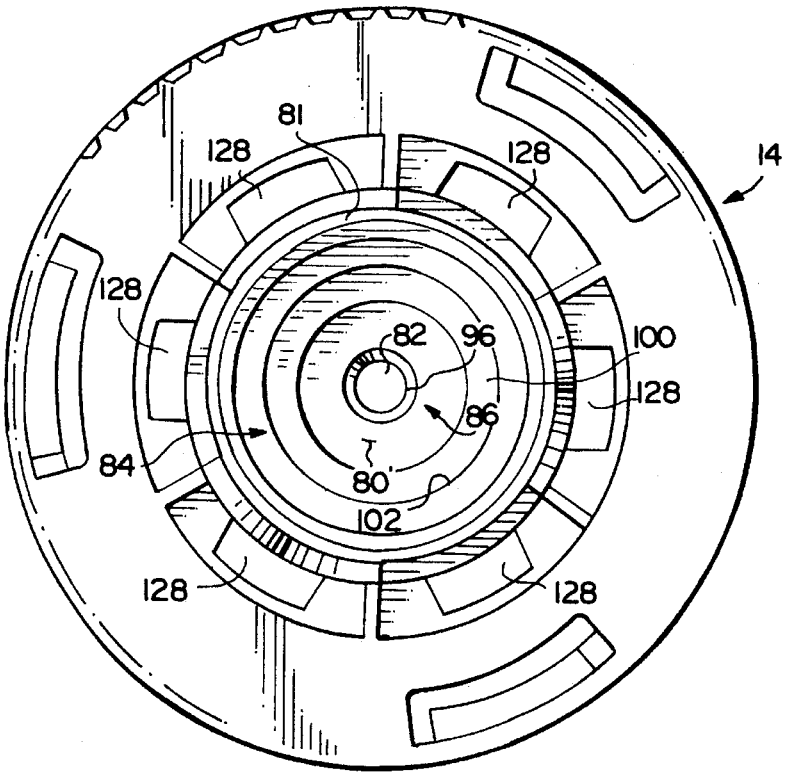
FIG. 8 is a bottom plan view of the cap shown in FIG. 7.

The cap assembly 20 incorporates a latch type securement mechanism of the type generally shown in commonly owned U.S. Pat. No. 5,409,168, and this aspect of the cap need not be described in detail here. The significant aspects of the cap assembly 20 (best seen in FIGS. 1, 7 and 8) for purposes of this invention relate to the center structure which includes a cylindrical recess 78 which is defined by a cylindrical sleeve 79 formed integrally with the cap, and located concentrically relative to the longitudinal center axis. The sleeve 79 has a diameter greater than hub 54 so that the sleeve 79 loosely receives the hub 54 of the plate. The base of the recess 78 is formed with a raised center surface 80 having a central aperture 82 therein (see FIG. 2) through which shaft 62 extends as shown in FIG. 1, with the shaft head 68 lying on the other side of the center surface 80 (i.e., the shaft 62 is inserted into the spray plate 20 through the aperture 82). From the top side of the cap assembly (see FIG. 8), a second coaxial and generally cylindrical recess 84 is provided, which extends in an opposite direction from recess 78, from the underside 80' of surface 80, with annular wall 81 shaped to provide a series of radial steps or shoulders as described further below. With reference especially to FIGS. 2 and 8, the base of recess 84 is formed with a reduced diameter recess 86, defined by base 80' and axial wall portion 88. An annular, resilient lip seal 90 is seated within the recess 86, the seal having a center aperture 92 defined by a frusto-conical interior edge 94 which engages a bevelled surface 96 in base 80 surrounding the aperture 82. Note that the lip seal 90 engages the shaft 62 substantially in the same plane as the center of motion of the spray plate 20, indicated by C in FIG. 2. This arrangement minimizes wear on the lip seal in that the tilting oscillating movement of the shaft 62 is minimized at this location.

The lip seal 90 is held in place by an annular seal retainer 98 which seats on radial surface 100, and which engages axial surface 102 as best seen in FIG. 1. The retainer 98 may be press fit or otherwise secured in any appropriate manner.

A ball bearing and separator assembly is seated in the recess or cage 84 with three balls 104, 106 and 108 seated in a disk-like separator 109 having three equi-spaced holes 110, 112 and 114 therein. Separator 109 seats on a radial surface 116 on the underside of a ball retainer cap 118 which is snap fit into place within the recess 84, with surface 116 cooperating with radial surface 120 to sandwich the separator 110 therebetween.

It will further be appreciated that the separator 109 prevents the otherwise freely movable balls 104, 106 and 108 from coming into contact with each other. The separator may be made of a polymer impregnated with solid lubricant so that during operation, the loose bearing balls where the separator and solid lubricant is thus wiped onto the balls, i.e., in a solid film transfer.

From FIG. 1, it can be appreciated that balls 104, 106 and 108 are essentially free to rotate within the separator, the balls engaging an annular partially spherical surface 122 within the recess 84, and also engaging the similarly radiused, part spherical head 68 of the shaft 64. Normally, a horizontal plane through the center of ball bearings 104, 106 and 108 is vertically offset from a parallel horizontal plane through the center on which the radiused head 68 is drawn.

The underside of cap assembly 14 mounts a stator or wear ring 124 in axial alignment with the sleeve 79. In other words, the inside diameter of the ring 124 is the same as the inside diameter of sleeve 79 such that the ring 124 essentially forms an axial extension of the sleeve. The ring 124 is snap fit into the cap assembly by means of a series of mounting tabs 126 arranged about the circumference of the ring, designed to be received in complementary apertures 128 (see FIGS. 7 and 8) formed in the cap assembly. The ring 124 is formed with a bevelled, annular wear or stator surface 130 (also referred to as the stator ring) which is engaged by rotor ring 70 of the rotator plate 20.

In use, a water stream exiting the nozzle 16 impacts the tilted rotor/spray plate 20 and travels through the grooves 22, exiting the plate on the outside diameter thereof. As the water stream travels through the grooves 22, it causes the rotor/spray plate 20 to nutate (oscillate with an off-center motion) about a common center of motion, i.e., the longitudinal center axis of the sprinkler. As the rotor/spray plate nutates, the nose of the plate 20 oscillates in, e.g., a clockwise direction. As the plate nutates about the longitudinal center axis, the part spherical shaft head 68 essentially orbits about the longitudinal axis, engaging the ball bearings 104, 106 and 108, and causing the latter to rotate and/or roll. The engagement between the head 68 and bearings 104, 106, 108 is essentially line contact (as in the case of tangential contact between two spheres) with all three bearings. In this regard, the similarly radiused head 68 may be regarded as a "fourth ball". In the position shown in FIG. 1, it can be seen that ball 106 has been caused to ride up on the ramp surface 122, and it will be understood that each ball will experience similar action, sequentially, as the shaft 64 nutates about the longitudinal axis. It should be noted here that the radiused surface 122 is drawn from the center of the "fourth ball", i.e., the center of the part spherical head 68. This bearing arrangement is particularly advantageous insofar as friction and wear are significantly reduced, thus adding to the service life of the sprinkler. At the same time, the bevelled surface or rotor ring 70 inside the skirt of the rotor plate 20 rolls around the stator ring 130 on the cap in continuous contact. As already mentioned, the circumference of the rotor ring 70 is less than the circumference on the stator ring 130, and thus the rotor/spray plate 20 indexes counter-clockwise a distance equal to the difference of the circumferences, as the spray plate 20 nutates in the opposite direction.

Thus, there will be some slippage of the rotor plate 20 on the stator ring 130 during operation, but such slippage is put to good use in that it will incorporate some randomness into the sprinkling pattern and enhance the overall uniformity of the wetted area.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler comprising a body portion having a nozzle at one end and a cap assembly supported thereon at an opposite end, said cap assembly supporting a spray plate located downstream of said nozzle, said spray plate having a plurality of stream distributing grooves formed on one side thereof configured to cause said spray plate to rotate when struck by a stream emitted from said nozzle; and wherein said spray plate includes a mounting shaft extending from said spray plate and having a part spherical head received within a bearing cage in said cap assembly, said bearing cage including a bearing separator holding a plurality of ball bearings in a substantially horizontal array arranged about a longitudinal center axis of said sprinkler, said part spherical head located centrally above and in engagement with said plurality of ball bearings, thereby permitting said spray plate to wobble as it rotates.

2. The sprinkler of claim 1 wherein said cap assembly is formed with an annular, bevelled stator surface engageable with an annular, bevelled rotor surface on an opposite side of said spray plate such that said rotor surface rolls about said stator surface in continuous contact therewith as said spray plate wobbles and rotates.

3. The sprinkler of claim 2 wherein said rotor surface has a first circumference less than a corresponding second circumference of said stator surface such that as said spray plate rotates and wobbles in one direction, said spray plate indexes relative to said stator surface in an opposite direction a distance equal to a difference between the first and second circumferences.

4. The sprinkler of claim 1 wherein said plurality of ball bearings comprises three ball bearings.

5. The sprinkler of claim 1 and including a flexible annular seal seated within said bearing cage, said seal having an aperture for receiving said mounting shaft, and wherein said aperture has a diameter less than a corresponding diameter of said mounting shaft.

6. The sprinkler of claim 1 wherein said spray plate is formed with a radially outer skirt extending in a direction toward said cap assembly to an extent sufficient to overlap said rotor surface and said stator surface.

7. The sprinkler of claim 1 wherein said bearing separator permits said ball bearings to orbit about said longitudinal axis and to rotate independently of each other, but prevents contact therebetween.

8. The sprinkler of claim 7 wherein said bearing separator is constructed of a polymer impregnated with a solid lubricant.

9. The sprinkler of claim 1 wherein said spray plate wobbles about a common center of motion and wherein said lip seal engages said mounting shaft in a plane passing through said center of motion.

10. A sprinkler comprising a body portion supporting a nozzle and a rotatable spray plate in axially spaced relationship to said nozzle, said spray plate having a mounting shaft formed with a part spherical head on an end thereof remote from said spray plate, said part spherical head received in a bearing cage containing a plurality of ball bearings.

11. The sprinkler of claim 10 wherein a plane through centers of the plurality of ball bearings is offset from a parallel plane through a center on which a radius of the part spherical head is drawn.

12. The sprinkler of claim 10 and including a rotor ring on said spray plate continuously engageable with a stator ring secured to said body portion.

13. The sprinkler of claim 12 wherein said plurality of ball bearings and said part spherical head permit said spray plate to nutate about a longitudinal axis of said sprinkler.

14. The sprinkler of claim 13 wherein said rotor ring has a circumference less than a corresponding circumference of said stator ring.

15. The sprinkler of claim 10 wherein said plurality of ball bearings comprises three ball bearings.

* * * * *